US005918420A

United States Patent [19]

Timmermann

[11] Patent Number: 5,918,420

[45] Date of Patent: Jul. 6, 1999

[54] HEIGHT-ADJUSTABLE VEHICLE WINDOW

[75] Inventor: Alwin Timmermann, Köln, Germany

[73] Assignee: Saint Gobain Vitrage, Aubervilliers Cedex, France

[21] Appl. No.: 08/887,707

[22] Filed: Jul. 3, 1997

[30] Foreign Application Priority Data

Jul. 6, 1996 [DE] Germany ..... 196 27 398

[51] Int. Cl.[6] ..... E05F 11/38

[52] U.S. Cl. ..... 49/375

[58] Field of Search ..... 49/375, 374, 352

[56] References Cited

U.S. PATENT DOCUMENTS

| | | | |
|---|---|---|---|
| 4,222,202 | 9/1980 | Pigeon . | |
| 4,306,378 | 12/1981 | Fukura et al. . | |
| 4,449,326 | 5/1984 | Hori et al. | 49/375 |
| 4,811,519 | 3/1989 | Gold | 49/375 |
| 5,050,348 | 9/1991 | Kane et al. | 49/375 X |
| 5,199,217 | 4/1993 | Roze | 49/375 |
| 5,398,449 | 3/1995 | Kobrehel et al. | 49/352 |

FOREIGN PATENT DOCUMENTS

| | | |
|---|---|---|
| 0 643 188 A1 | 3/1995 | European Pat. Off. . |
| 30 01 617 | 8/1980 | Germany . |
| 295 03 036 | 4/1995 | Germany . |
| 1 432 746 | 4/1976 | United Kingdom . |

*Primary Examiner*—Jerry Redman

*Attorney, Agent, or Firm*—Pennie & Edmonds LLP

[57] ABSTRACT

In the case of a height-adjustable vehicle window, a holding element (35) provided with a runner (25) is fixed at the bottom edge of the window pane (21). The runner (25) engages in a rigid guiding slideway (22) which is fitted into the door casing and can move by sliding along the guiding slideway (22). The holding element (35) and the runner (25) are made of a polymer which can be mechanically stressed and constitute a component molded as a single piece. Provided between the holding element(35) and the runner (25) is a connection piece (37) of smaller cross-section. The tolerances imposed by the manufacture and fitting of the constituent components are compensated for by the elastic deformation of this connection piece (37). The runner (25) and the guiding slideway (22) are joined together by press-fitting the runner (25) onto a central rib (24) of the guiding slideway (22) by elastically deforming the runner (25).

10 Claims, 1 Drawing Sheet

HEIGHT-ADJUSTABLE VEHICLE WINDOW

BACKGROUND OF THE INVENTION

The present invention relates to a height-adjustable vehicle window, comprising a window pane to the bottom edge of which is fixed a holding element provided with a runner, which engages in a rigid guiding slideway fitted into the door casing and which can move by sliding along the guiding slideway.

Height-adjustable vehicle windows of this type are furthermore provided with a driving member to which is attached, as a general rule, a traction cable moved manually or by an electric motor. This driving member may be fitted on the holding element or on the runner. The purpose of the runner and the guiding slideway is to ensure reliable guiding of the window pane in such a way that, in certain circumstances, it is possible to dispense with guiding slideways provided on the sides in the door casing.

In the case of a vehicle window known from the document DE 3,001,617, the holding element and the runner are manufactured as a single plastic component, the runner being connected to the holding element over the entire length by which it slides in a split guiding tube. In the case of this arrangement, the runner may easily become jammed in the guiding tube when adjusting the height of the window if the various elements of the window are not fixed and installed with great precision.

A height-adjustable vehicle window of the abovementioned type, in which the holding element consists of two clamping plates which are fixed by means of a screw to the edge of the window, is known from the document DE 4,102,941.

In this case, the runner is screwed with the clamping plates. In this case too, the constituent components must be fitted with great accuracy if it is desired to avoid the risk of the movement becoming hard because of the runner and guiding slideway jamming when adjusting the height of the window pane.

BRIEF DESCRIPTION OF THE INVENTION

The object of the invention is to provide a height-adjustable vehicle window of the type mentioned hereinabove, in which the risk of jamming when adjusting the height of the window is greatly reduced, and for which it is not necessary to meet the requirement of great precision when fitting and adjusting the constituent components, thus enabling the labour content to be reduced.

This object is achieved, in accordance with the invention, by the fact that the holding element and the runner are made of a polymer which can be mechanically stressed and constitute an integral part and by the fact that provided between the holding element and the runner is a connection piece of smaller cross-section, so that the tolerances imposed by the manufacture and fitting of the constituent components are compensated for by the elastic deformation of this connection piece.

The polymer, of which the molded component comprising the holding element, the connection piece and the runner is composed, must also have the mechanical strength and hardness which are required to guarantee stable and reliable guiding of the window pane while it is being moved up and down. Semi-hard polymers, having a hardness of between Shore A 80 and Shore D 80, more particularly having a Shore A hardness of between 80 and 90 or a Shore D hardness of between approximately 30 and 80 (Shore A and D hardness test according to the DIN 53505 standard) have proved to be effective. On the one hand, because of the reduction in the cross-section of the connection piece between the holding element and the runner, the stability of the molded component, which is necessary in order to ensure reliable guiding, cannot be excessively reduced. On the other hand, this reduction in the cross-section must be designed so as to achieve sufficient flexibility between the holding element and the runner. The amount of reduction in the cross-section of the connection piece must therefore be chosen by taking these points of view into account. It depends on the polymer used in each case and may be easily determined for each individual case by experiments.

With regard to the molded polymer component, this may be a prefabricated component which is fixed to the window pane by a known process, for example by snap-fastening assembly, by screwing or by adhesive bonding.

According to one particularly advantageous embodiment of the invention, the molded component consists, however, of a body made of a polymer coming from a thermoplastic polymer or from a reaction system and molded directly onto the window. The molded body in this case is shaped and fixed in a single operation, for example by using the injection moulding process or the reaction injection moulding process (RIM process). Where appropriate, care is taken, by means of a suitable prior treatment of the glass surface, to ensure that there is a lasting bond onto the window pane.

BRIEF DESCRIPTION OF THE DRAWINGS

Other constructional aspects and advantages of the invention will emerge from the following description of various illustrative embodiments, with reference to the appended drawing.

In the drawing.

DETAILED DESCRIPTION OF THE INVENTION

Figure 1:
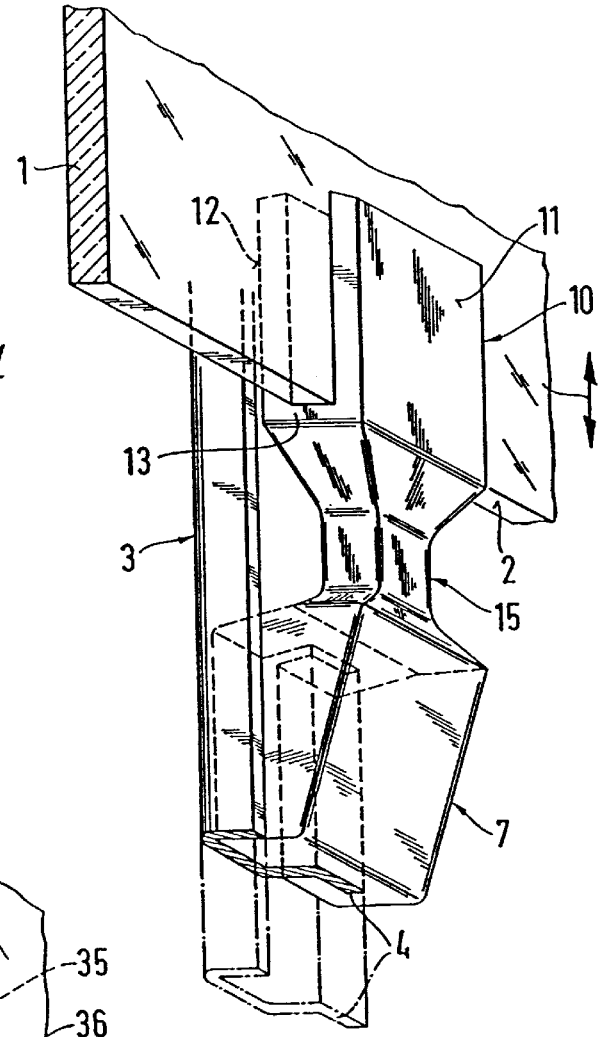
FIG. 1 is a sectional view of a height-adjustable window in the region of the guiding device, according to a first embodiment.

The window 1 is a height-adjustable door-window pane. In the case shown, this is a sheet of monolithic safety glass, but it may also be a sheet of laminated safety glass. The bottom marginal region of the window pane 1, shown here by its bottom peripheral surface 2, is inside the door (casing) even when the window pane is in the closed position. The rigid guiding slideway 3, for example an aluminum section, is permanently fitted in the door casing in an approximately vertical orientation. The guiding slideway 3 must have a cross-section such that it enables the runner, which slides along the slideway, to maintain its position in the guiding slideway. For this purpose, in the present case, the guiding slideway 3 of cross-section having a U-shaped profile is provided with a right-angled flange 4.

The runner 7 engages with the guiding slideway 3 and its cross-section, in the region of the sliding surfaces, corresponds to the cross-section of the guiding slideway 3. The holding element 10, comprising two side parts 11, 12 in the form of sheets and a bottom part 13, serves to connect the runner 7 to the window 1. The holding element 10 is solidly adhesively bonded to the window pane 1.

The runner 7 and the holding element 10 form part of the same molded body made from a suitable polymer. The holding element 10 and the runner 7 are joined together by the connection piece 15. This connection piece 15 has a smaller cross-section than the adjacent part of the runner 7. It is necessary in this case to chose the dimensions of the cross-section and the length of the connection piece 15 depending on the mechanical properties of each polymer used, in such a way that the connection piece 15 transfers, without any problems the tensile and compressive forces involved and ensures the necessary stability of the guiding, while still maintaining sufficient elasticity and sufficient flexibility.

The molded polymer body assembly, comprising the runner 7, the holding element 10 and the connection piece 15, is preferably manufactured in situ by injection or moulding of a polymer onto the edge of the window 1. For this purpose, a mould is used for the appropriate injection moulding, the edge of the window is put into the mould and, for example in the RIM process, a reaction mixture composed of a suitable isocyanate component and of a suitable polyol component is injected into the mould. The reaction mixture bonds directly to the glass surface which, where appropriate, has been treated beforehand by means of a suitable adhesive bonding agent, and reacts in the mould to form the molded body.

Furthermore, a lifting and lowering mechanism is fitted into the door casing and is connected to the molded body via a driving member. The driving member and the window lift are not, however, shown in these figures.

Figure 2:
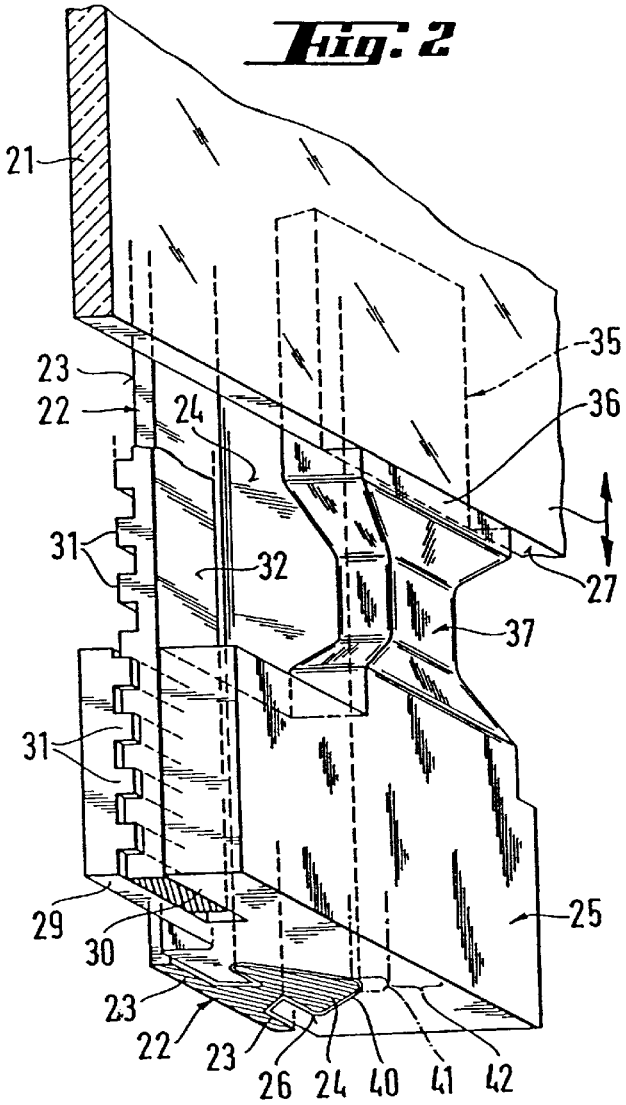
FIG. 2 is a sectional view of a height-adjustable window in the region of the guiding device, according to another embodiment.

FIG. 2 shows another embodiment. In the case of this embodiment, the window pane 21 moves along the guiding slideway 22. The guiding slideway 22 consists of a flat metal section 23 and of a central rib 24 of triangular or mushroom-shaped cross-section. The runner 25, which engages in this guiding slideway 22, includes a longitudinal channel 26 of corresponding cross-section. Such a configuration of the runner and of the guiding slideway has the advantage of making it easier to fit the window pane 21 provided with the runner 25 into the door casing.

This is because the runner 25 can then be fitted onto the rib 24 simply by pressing it, given that, by virtue of its elasticity, the polymer material deforms under the effect of the pressure and resumes its initial shape as soon as it has attained the final position. In order to increase the elasticity when press-fitting the runner, the bending region 42 of the runner may be reduced by a slot 41.

The runner 25 has lateral projections 29, 30, among which projections the projection 29 is provided with teeth 31. Clamped between these projections 29, 30 is a toothed belt 32 serving to transfer the window-lift force to the runner 25 and thus to the window pane 21.

The runner 25 and the window pane 21 are once again joined together by means of a holding element 35 adhesively bonded to the window pane 21, to which holding element is connected, on its bottom part 36 lying level with the bottom peripheral surface 27 (bottom edge) of the window pane 21, the connection piece 37 of reduced cross-section.

Figure 3:
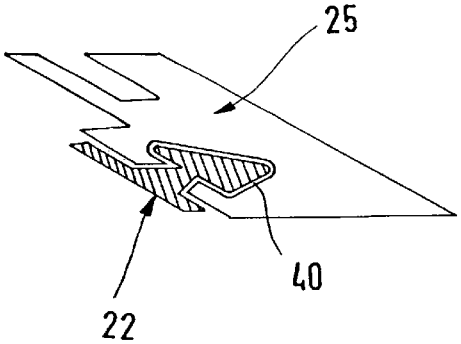
FIG. 3 is a bottom view of the runner 25 and the guiding slideway 22.

The entire molded component, comprising the runner 25, the holding element 35 and the connection piece 37, is again injected onto the window pane 21, as described with reference to FIG. 1, by means of the injection-moulding technique or the RIM process, where appropriate with a suitable prior treatment of the glass surface. In this regard, when the polymer used for moulding the body has too low a slip capability, a sliding liner 40, suitably profiled and made of another material, which possesses good slip properties, may, where appropriate, be incorporated into the runner 25 in the region of the sliding channel 26. FIG. 3 more clearly shows the sliding liner 40 incorporated into the runner.

I claim:

1. In a height-adjustable vehicle window in a door casing and including a window pane to which is fixed a holding element provided with a runner, wherein said runner engages a rigid guiding slideway fitted into the door casing and can move by sliding along the guiding slideway, the improvement wherein:

a) the holding element engages a bottom edge of the window pane, and the holding element (10, 35) and the runner (7, 25) constitute a single piece component made of a polymer which can be mechanically stressed;

b) said single piece component includes a connection piece (15, 37) connected between and integral with said holding element (10, 35) and runner (7, 35); and c) said connection piece (15, 37) being of smaller cross-section than the holding element and the runner, so that the tolerances imposed by manufacture and fitting of said component to the window pane and guiding slideway are compensated for by elastic deformation of the connection piece (15, 37).

2. The height-adjustable vehicle window according to claim 1, wherein the component, comprising the holding element (10, 35), the connection piece (15, 37) and the runner (7, 25), is a molded polymer construction having a hardness of between Shore A 80 and Shore D 80.

3. The height-adjustable vehicle window according to claim 1, wherein the component, comprising the holding element (10, 35), the connection piece (15, 37) and the runner (7, 25), comprises a prefabricated component which is fixed to the window pane (1, 21).

4. The height-adjustable vehicle window according to claim 1, wherein the component, comprising the holding element (10, 35), the connection piece (15, 37) and the runner (7, 25), is constructed of a thermoplastic polymer or a reaction system molded directly onto the window (1, 21).

5. The height-adjustable vehicle window according to claim 4, wherein the component, comprising the holding element (10, 35), the connection piece (15, 37) and the runner (7, 25), is constructed of a polyurethane system molded onto the window (1, 21) using the RIM process.

6. The height-adjustable vehicle window according to claim 4, wherein the component, comprising the holding element (10, 35), the connection piece (15, 37) and the runner (7, 25), is constructed of an injection molded thermoplastic polymer molded onto the window (1, 21).

7. The height-adjustable vehicle window according to claim 1, wherein the runner (25) has a driving member (29, 30) to which a force-transferring element (32) is coupled.

8. The height-adjustable vehicle window according to claim 7, wherein the force-transferring element (32) comprises a toothed belt coupled to the driving member (29, 30) by teeth (31) provided in the driving member (29, 30).

9. In a height-adjustable vehicle window in a door casing and including a window pane to which is fixed a holding element provided with a runner, wherein said runner engages a rigid guiding slideway fitted into the door casing and can move by sliding along the guiding slideway, the improvement wherein:

a) the holding element (10, 35) and the runner (7, 25) constitute a single piece component made of a polymer which can be mechanically stressed;

b) said single piece component includes a connection piece (15, 37) connected between and integral with said holding element (10, 35) and runner (7,35);

c) said connection piece (15, 37) being of smaller cross-section than the holding element and the runner, so that the tolerances imposed by manufacture and fitting of said component to the window pane and guiding slideway are compensated for by elastic deformation of the connection piece (15, 37); and d) the guiding slideway (22) includes a rib 24 of mushroom-shaped or triangular cross section, and said runner (25) includes a correspondingly shaped channel (26), press-fitted onto said rib (24) by an elastic splaying action.

10. In height-adjustable vehicle window in a door casing and including a window pane to which is fixed a holding element provided with a runner, wherein said runner engages a rigid guiding slideway fitted into the door casing and can move by sliding along the guiding slideway, the improvement wherein:

a) the holding element (10, 35) and the runner (7, 25) constitute a single piece component made of a polymer which can be mechanically stressed;

b) said single piece component includes a connection piece (15, 37) connected between and integral with said holding element (10, 35) and runner (7, 35);

c) said connection piece (15, 37) being of smaller cross-section than the holding element and the runner, so that the tolerances imposed by manufacture and fitting of said component to the window pane and guiding slideway are compensated for by elastic deformation of the connection piece (15, 37); and d) the runner (25) includes a surface slideably engaging in the guiding slideway (22), said surface being defined by a liner (40) of a material having greater slip capability than said component, said liner being incorporated, by moulding, into the runner.

* * * * *